US006307945B1

(12) United States Patent
Hall

(10) Patent No.: US 6,307,945 B1
(45) **Date of Patent: *Oct. 23, 2001**

(54) RADIO-BASED HEARING AID SYSTEM

(75) Inventor: Andrew James Jamieson Hall, Nelson (GB)

(73) Assignee: Sense-Sonic Limited, Chesire (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/384,395

(22) Filed: Feb. 3, 1995

Related U.S. Application Data

(63) Continuation of application No. 08/078,220, filed as application No. PCT/GB91/02316 on Dec. 23, 1991, now abandoned.

(30) Foreign Application Priority Data

Dec. 21, 1990 (GB) ..... 9027784

(51) Int. Cl.[7] ..... H04R 25/00
(52) U.S. Cl. ..... 381/315; 381/331
(58) Field of Search ..... 381/68.6, 68, 68.3, 381/79, 68.4, 68.7, 312, 314, 315, 322, 323, 328, 329, 331; 181/129, 135; 455/95, 100, 351

(56) References Cited

U.S. PATENT DOCUMENTS

| | | | | |
|---|---|---|---|---|
| 3,087,117 | * | 4/1963 | Mitchell | 455/100 |
| 3,125,646 | * | 3/1964 | Lewis . | |
| 3,809,825 | * | 5/1974 | Schaad et al. | 381/79 |
| 3,975,599 | | 8/1976 | Johanson . | |
| 3,985,977 | * | 10/1976 | Beaty et al. . | |
| 4,051,330 | * | 9/1977 | Cole . | |
| 4,751,738 | * | 6/1988 | Widrow et al. | 381/68.5 |
| 4,888,807 | * | 12/1989 | Reichel | 381/92 |
| 4,941,187 | * | 7/1990 | Slater | 381/94 |
| 5,148,491 | * | 9/1992 | Sakamoto et al. | 381/92 |
| 5,204,908 | * | 4/1993 | Sims | 381/92 |
| 5,425,104 | * | 6/1995 | Shennib | 381/68.6 |
| 5,434,924 | * | 7/1995 | Jampolsky | 381/68.4 |

FOREIGN PATENT DOCUMENTS

| | | |
|---|---|---|
| 859258 | 12/1980 | (CA) . |
| 2844979 | 4/1980 | (DE) . |
| 3742877 | 6/1989 | (DE) . |
| 2153154 | 5/1973 | (FR) . |
| 2648294 | 12/1990 | (FR) . |
| 1099344 | 1/1968 | (GB) . |
| 1565701 | 4/1980 | (GB) . |

OTHER PUBLICATIONS

Advertisement for Environ Model 2N1 Microphone from Ingenoics, Inc., Gaithersburg, Maryland, Jun., 1970.*

International Search Report of Corresponding PCT/GB91/02316.

* cited by examiner

*Primary Examiner*—Xu Mei
(74) *Attorney, Agent, or Firm*—Salter & Michaelson

(57) ABSTRACT

A personal radio-based hearing aid system is provided. The hearing aid system interfaces with existing hearing aids using the "T" facility. The system comprises a switchable unidirectional or omnidirectional microphone; a line input; and an FM radio transmitter. The components are housed in a discrete hand-held unit with integral stand, and a FM receiver unit connected to an inductive loop to form a discrete pendant and necklace. The prime use of said system is to give the user greater control over his environment by using the system to compensate for the loss of natural aural focus. The system addresses the problems of a "background noise" by capturing the desired sounds by selection

10 Claims, 8 Drawing Sheets

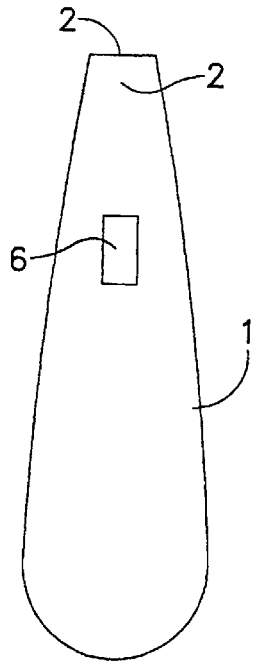
FIG. 1A
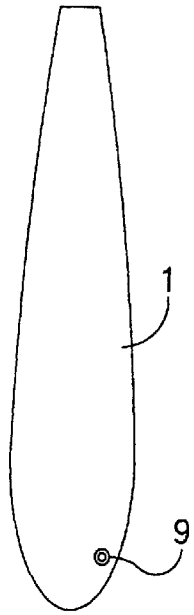
FIG. 1B
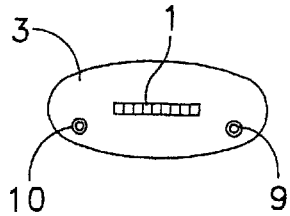
FIG. 1C
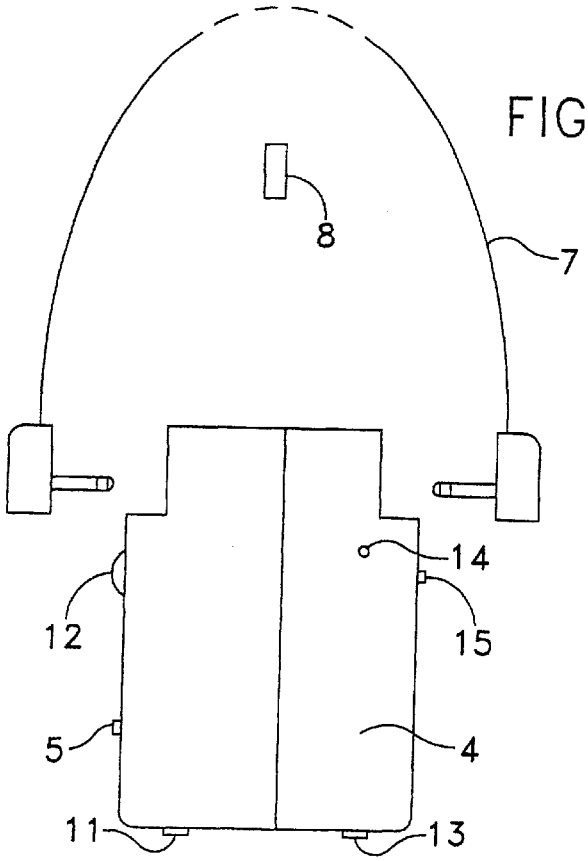
FIG. 2A
FIG. 2B
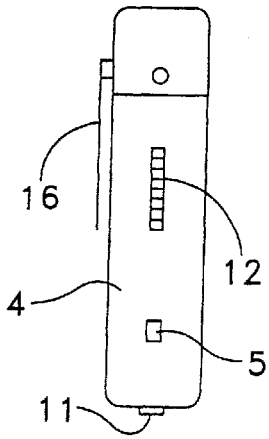

RADIO-BASED HEARING AID SYSTEM

This is a continuation of U.S. application No. 08/078,220 filed on Aug. 13, 1993 now abandoned, which is a 371 of PCT/GB91/02316 filed Dec. 23, 1991.

This invention relates to hearing aid systems, and in particular to improving the clarity of sound delivered to the ear by such hearing aid systems.

An impaired ear is unable to select an individual sound source when confronted with several other sources simultaneously and most hearing aid devices are designed to enhance the chosen source.

An Ear-trumpet was a most useful device in that it addressed the requirement to direct the sound source (at the bell) directly into the ear. Early electronic hearing aids introducedamplification. The bell of the Ear-trumpet was replaced by a microphone and the ear-piece of the trumpet was placed by a loudspeaker. This provided hands-free operation but the microphone was in a fixed position, relaying all surrounding sounds to the ear via the amplifier. Continuous noise and ugly appearance limited the success of these devices.

Hearing aid design has been side-tracked by the less important aspects of hearing aids, in particular their size, appearance and placement. These factors may well seem important to newly diagnosed sufferers of hearing loss, but are of considerably less importance to long term sufferers who would prefer improved performance. Behind-the-ear and in-ear hearing aids help to disguise the user's disability but this has meant that the microphone was also concealed, resulting in poor directionality, which in turn resulted in a poor signal to noise ratio.

Research to improve hearing aids concentrated on reducing hearing aid size, often by including complex electronics within the device. This approach has often negated the effectiveness of the aid in terms of clarity of sound and ease of use. For example, the effect of the user's head causes a microphone (in a behind-the-ear and in-ear hearing aid) to be less directional—often resulting in the picking up of sounds from outside the user's desired range. Furthermore, in difficult listening conditions, such as a crowded room, the hard of hearing will often turn the head so that the better ear faces the speaker in order to improve the signal to noise ratio, but in doing so the aid is then pointing in the wrong direction. This situation highlights one of the major problems with existing hearing aids—the aid can, at best, only enhance sounds coming from the direction in which the user is facing.

A further major problem is that of head shadowing, a condition which occurs when the head is between the hearing aid and the sound source, thereby rendering many sound sources inaudible.

An additional problem with existing hearing aids is that they have no facility for discreetly and easily adjusting the functionality of the hearing aid so as to select the best listening conditions at a given moment. Although remote control aids are available, they do not adequately address or overcome the fundamental problems mentioned above. With conventional behind-the-ear and in-ear hearing aids the volume controls are minute and relatively inaccessible when the hearing aid is in use. Aged, disabled and arthritic people can not easily adjust the hearing aid controls and many users simply can not feel the click of a volume adjustment wheel when switching an in-ear hearing aid off.

Directional behind-the-ear or in-ear hearing aids make side-by-side conversations difficult, as the aid is set to capture sounds from the direction in which the user is facing.

In these circumstances it is often better not to have the aid switched on, but with the difficulties of regulating and/or adjusting the miniaturized controls this is often impractical.

Finally, because designers have placed the microphone so close to the loudspeaker (in the ear-piece), the volume threshold is considerably lower. This means that to avoid whistling feed-back the user must either avoid loud sound sources or set the volume control at a low level.

An aim of the present invention is to overcome all of the aforementioned disadvantages and to devise a system putting the performance of the hearing aid system ahead of appearance and size.

According to a first aspect of the invention there is provided a hearing aid system comprising: a unit having a microphone and a transmitter; a receiver unit for receiving a signal from the transmitter unit; the receiver unit being contained in a housing with an amplifier; an induction loop connected to the amplifier; and an ear piece capable of receiving a signal from the induction loop and transmitting an audio signal.

According to a second aspect of the invention there is provided a hearing aid system comprising: a portable device having a microphone and a transmitter; a receiver unit for receiving a signal from the transmitter unit; the receiver unit being contained in a housing with an amplifier; an ear piece for connection to the amplifier and receiving a signal therefrom, and for transmitting an audio signal.

Preferably the housing containing the receiver unit and the amplifier is in the form of a pendant which may be suspended around a user's neck. However, it will be appreciated that the housing may be carried in a user's pocket or attached to the clothing.

Because the microphone is built into a small hand-held unit, which is preferably portable, along with a transmitter, which is preferably transmitting at radio frequency, the unit is free to be moved independently of the head thus avoiding the aforementioned problems of head shadowing and partial directivity and frequency response.

The microphone can always have a clear view of the sound source. In many situations it can be placed by the sound source, permitting the user to move freely around and independently of the microphone, thus maintaining the best possible access to the sound source. With the microphone being placed well away from a loudspeaker or ear-piece, feedback will not occur until the amplification levels exceed the ear's natural threshold. This means that the user has access to far greater amplification than before. In addition the signal is of higher quality than previously obtainable on account of its superior directivity. Signal quality is further improved as the hearing aid operates almost silently in the 'T' mode. Ambience is also reduced as the microphone is able to effectively reduce its distance from the sound source.

Additionally, the invention also provides for functional controls of the system to be located on the remote unit, with possibly some of the controls located on the pendant. These controls may be designed so that they are large and adapted for easy use by infirm persons. This makes the device extremely user-friendly enabling simple and accessible control of the whole arrangement. It is much easier to adjust the controls on the hand-held unit as this is a relatively large device and the controls are visible to the user. This is a considerable improvement upon the controls of existing behind-the-ear or in-ear hearing aids. The ability to easily control the volume level of the hearing aid results in improved hearing. The controls are designed in particular to be accessible to the elderly which comprise the majority of users, and also the arthritic and infirm user.

According to a third aspect of the present invention there is provided a directional microphone for receiving an audio signal for subsequent amplification.

The signal may be transmitted to a remote amplifier.

A particular feature of the invention is the capability of the microphone to be operated either directionally or as an omnidirectional microphone, thus providing greater flexibility in sound directionality requirements of the user.

The receiver unit may be fitted with a local microphone, thus giving the user more flexibility in his choice of access to sound sources. The local microphone can be used instead of temporarily returning the hearing aid to its own built-in microphone. Furthermore, the receiver unit amplifier can be provided with frequency equalizers to adjust the sound received to remove unnecessary frequencies and to boost others.

Means may be provided on a housing containing the microphone and transmitter, for selectively switching the microphone to a directional microphone or an omnidirectional microphone. The means may comprise a mechanical switch, which may be a slideable door opening or closing first and second input ports. Alternatively the switch may be an electronic switch arranged to selectively switch first and/or second microphones into and/or out of circuit.

According to a fourth aspect of the present invention there is provided electrical apparatus having a housing for receiving a battery and a cap for closing the housing, the housing being adapted to receive an insert, when the cap is removed, the insert having first and second contacts for permitting an electric current to pass to and from the apparatus.

Embodiments of the invention will now be described by way of example only and with reference to the drawings wherein:

FIG. 1A shows an above plan view of a remote portable microphone/transmitter unit;

FIG. 1B shows a side elevational view of the remote portable microphone/transmitter unit;

FIG. 1C shows an end view of the remote portable microphone/transmitter unit;

FIG. 2A shows an above plan view of receiver/amplifier unit and induction loop necklace;

FIG. 2B shows a side elevational view of the receiver/amplifier unit;

Figure 2C:
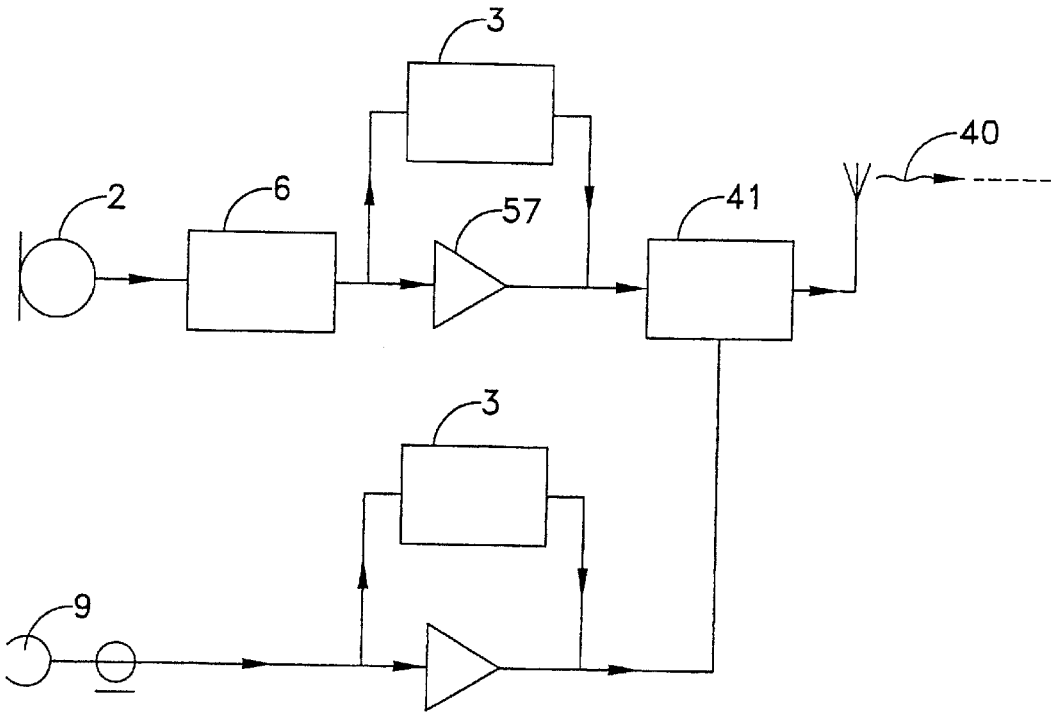
FIG. 2C is a block diagram showing diagrammatically the circuit of the microphone/transmitter unit of FIG. 1A.

As can be seen from FIG. 1, a portable microphone and transmitter unit 1 comprises an elongate member approximately 9 cm long, formed from an injection moulded synthetic plastics material. The unit 1 houses a directional microphone 2 located at one end. Mounted on an upper surface is a 'mode select' and an 'on/off' switch 6 which enables a user to choose between having a directional or an omnidirectional microphone. The switch 6 also switches the microphone on or off.

Design of switch 6 is such as to enable handicapped or infirm users to operate it without difficulty. At the end of the unit 1 which may be a hand-held portable unit, opposite the microphone 6 is located a volume control dial 3 with which the user is able to control the strength of a signal 40 transmitted to receiving unit 4 shown in FIGS. 2A and 2B. The unit 1 is designed to be comfortably held within the palm of the user's hand and also to be easily rested on a table surface, for example in front of a television (not shown).

There is also a miniature line input socket 9 provided on the side of the transmitter unit 1 to allow connection to a standard line output of audio or television equipment (not shown). The unit 1 is powered by miniature batteries which may or may not be rechargeable. Alternatively, the unit 1 may be powered from an external power source such as mains electricity via a transformer or an adaptor. The unit 1 may be connected to such an external power source by input socket 10 on the side of the unit 1.

Figure 7A:
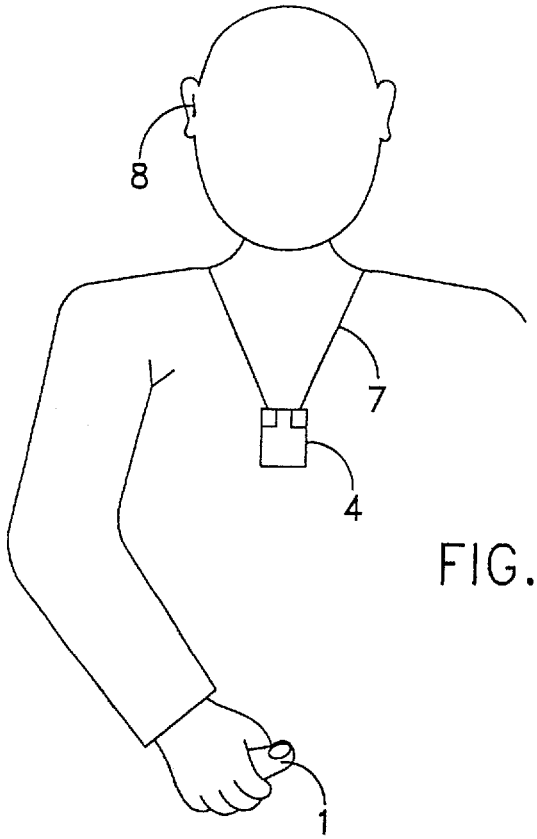
FIG. 7A is a diagram of a user wearing the system shown in FIGS. 1A and 2A.

Referring briefly to FIG. 7A a user is shown wearing a receiver unit 4, described below with reference to FIGS. 2A and 2B and carrying a transmitter unit 1 as shown in FIGS. 1A, 1B and 1C.

A signal from the microphone 2, or input socket 9, is transmitted to a receiver/amplifier unit 4 which is shown in FIGS. 2A and 2B, as a generally rectangular slim box of approximately two-thirds of a credit card's length and approximately 1 cm thick, containing necessary electronic circuitry to receive the signal 40 from the portable microphone/transmitter unit 1, and to amplify the received signal. The receiver unit 4 is in the form of a pendant and has an easily operable "stand-by on/off" switch 5. Alternatively, a push switch (not shown) may be positioned on the front of the unit 4. The unit 4 is powered by miniature batteries which may or may not be rechargeable. Alternatively, the unit 4 may be powered from an external power source such as mains electricity via an adaptor (not shown). The unit 4 is connected to such external power source by an input socket 11 on the base of the unit 4.

The unit 4 also has a volume control dial 12 on one side. The unit 4 may also be provided with a microphone 14 to enable the user to receive sounds closer to him than those detectable by the remote unit 1. The receiver units' microphone 14 is operated by a switch 15 on the unit 4 which controls whether it is on or off or being used instead of, or in addition to, the remote microphone 2 on the hand unit 1.

The microphone 14 may be connected to an amplifier 56. A variable threshold noise-gate which has a multi-way switch 15 allows sounds such as the ring of a door bell or telephone to be heard via an ear-piece 8 whilst the hand unit 1 is operating in a unidirectional or line input mode. The multi-way switch 15 not only switches the microphone 14 on or off, but it also provides a selection of volume thresholds for the noise-gate if required. The microphone 14 can be operated with or without the noise-gate.

Figure 2D:
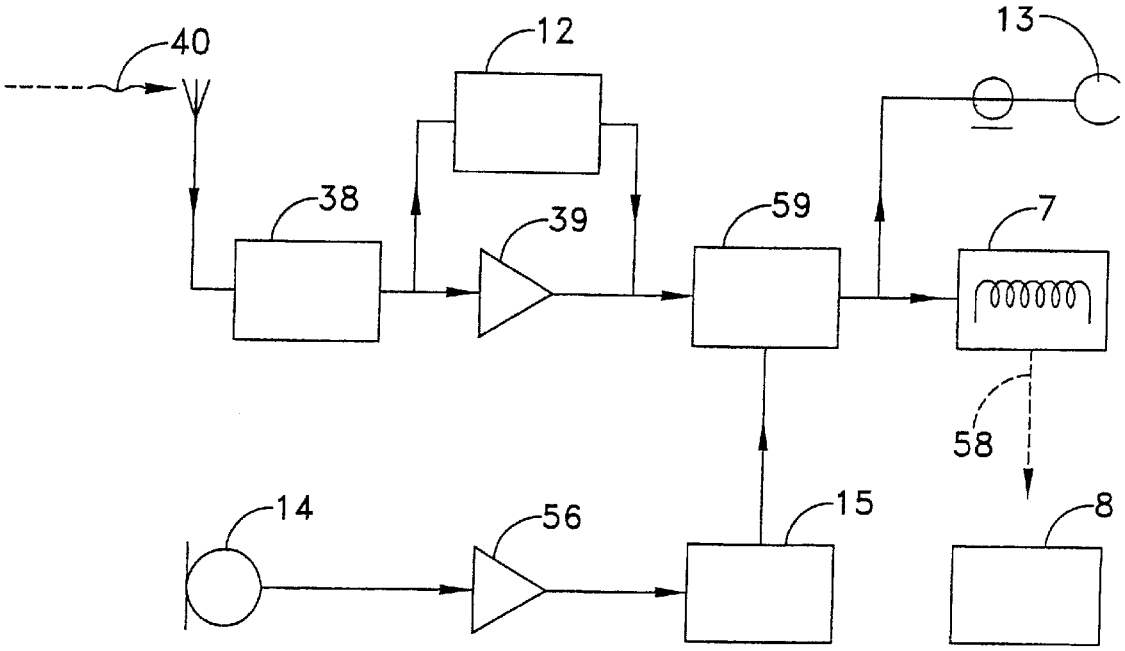
FIG. 2D is a block diagram of the circuit of the receiver/amplifier unit of FIG. 2A.
Figure 3A:
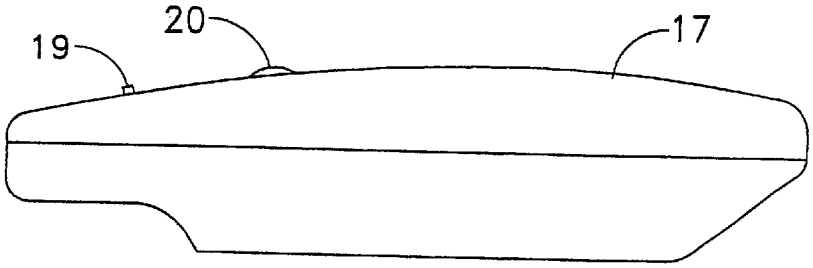
FIG. 3A is a side elevation view of an alternative embodiment of a microphone/transmitter unit.
Figure 3B:
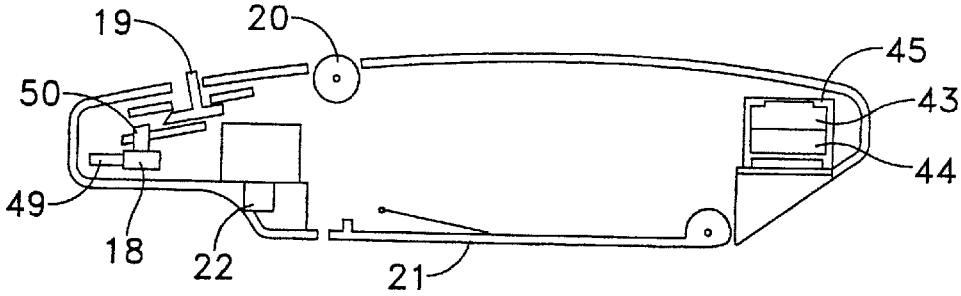
FIG. 3B is a sectional view of the microphone/transmitter unit of FIG. 3A.
Figure 3C:
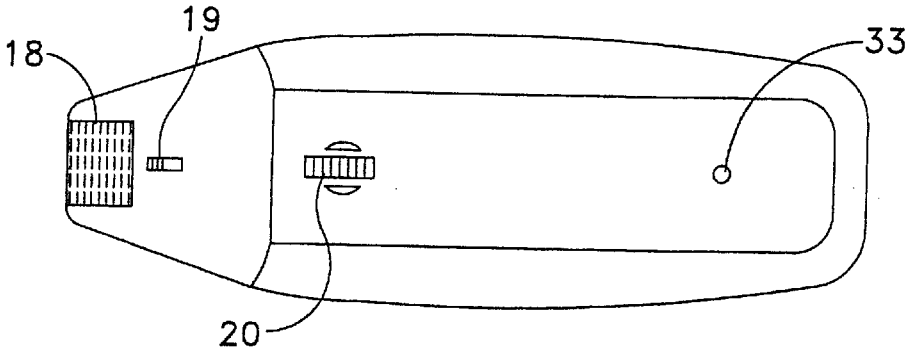
FIG. 3C is an above plan view of the microphone/transmitter unit of FIG. 3A.
Figure 3D:
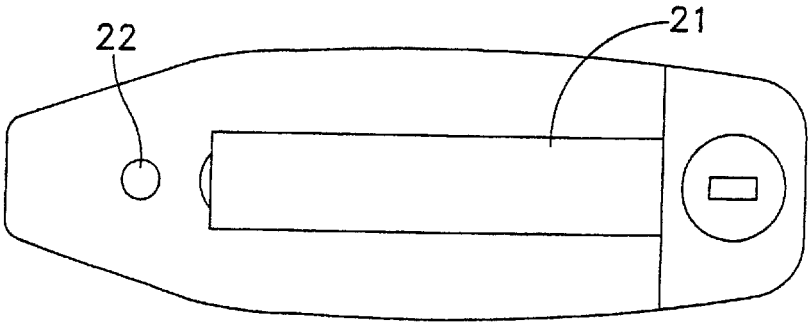
FIG. 3D is an underplan view of the microphone/transmitter unit of FIG. 3A.
Figure 3F:
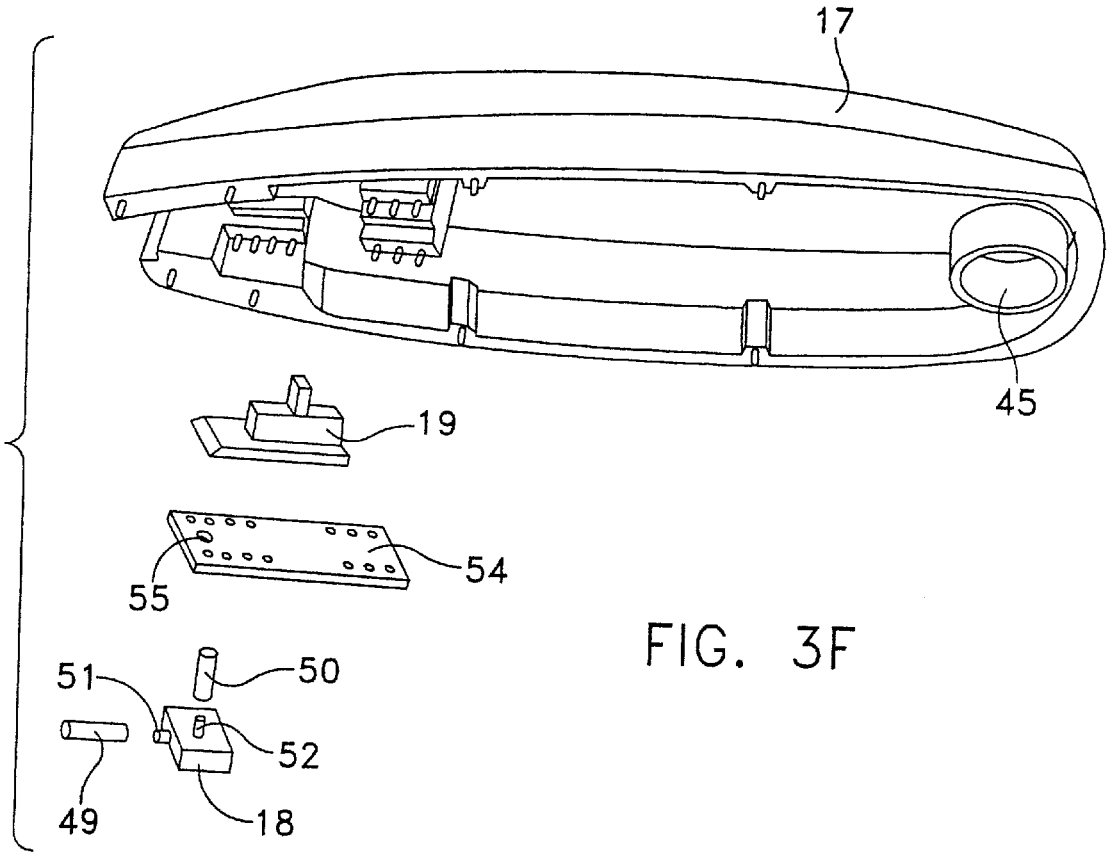
FIG. 3F is a perspective view, from below of an upper housing compartment of the microphone/transmitter unit of FIG. 3A.
Figure 3E:
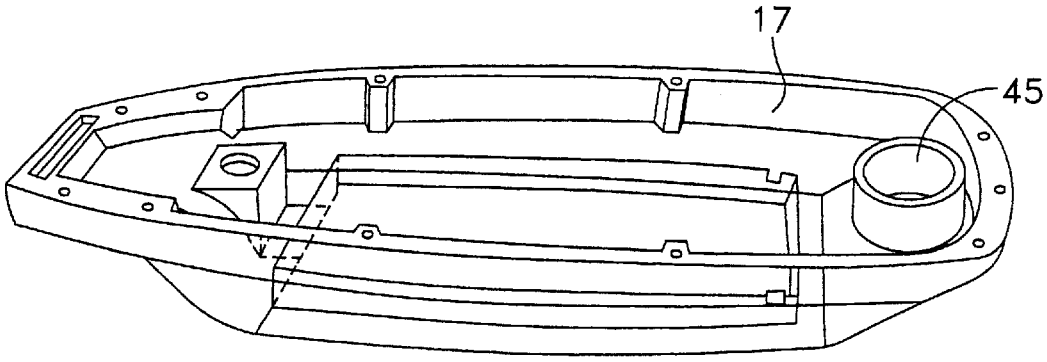
FIG. 3E is a perspective view from above, of a lower housing compartment of the microphone/transmitter unit of FIG. 3A.

Connecting to, or arising from, the top of the unit 4 is an induction loop 7 in the form of a necklace which is connected to a radio receiver 38 in the unit 4, via an amplifier circuit 39, shown in detail in FIG. 2D. A signal passes into the light-weight, non-kink induction loop 7, which passes to a hearing aid ear-piece 8 arranged within the magnetic field of the loop i.e. placed within the ear in the vicinity of the induction loop necklace 7. A conventional hearing aid, shown in FIGS. 2A, 2D and 7A set to receive in the 'T' mode (telephone/loop mode), will receive the signal 58, converting it into an audible signal within its own ear-piece 8. In this mode there is little or no noise from the hearing aid and the receiver will only pass on the signal to the loop when the microphone/transmitter unit 1 is transmitting. This means that the hearing aid can be set to, and left at, full volume. The level of signal is controlled from the portable remote microphone/transmitter unit 1 or the receiver unit 4.

An induction loop is simply a length of fine copper wire looped three times to a diameter of approximately 25 cm. The coil from a small 8 Ohm loudspeaker could be removed, unwound and looped three times to create an induction loop. The two ends of the loop are connected to output terminals of the receiver. A booster amplifier 39 may be connected between the receiver output and the loop. An integrated circuit (IC) is available from "Radio Spares" (Suppliers of electronic components in the UK) which is a complete amplifier on a chip. No additional components are needed. As an alternative to the induction loop method of activating the ear-piece 8, the receiver unit 4 may also have an output socket 13 into which a headphone plug (not shown), or other means of connection to the ear-piece 8, may be inserted.

The directional microphone 2 can focus on specific sound sources at a distance of several meters if it is mounted in a well designed shell. Connecting the microphone 2 to a miniature radio transmitter (within the shell) enables the unit 1 to move independently of the rest of the system, giving it the best possible chance of gaining direct access to the chosen sound source. The unit 1 can be held in the hand and pointed towards the sound source or alternatively it can be placed near to, or in full view of, the sound source. Within the portable unit 1 there is a facility 6 for selecting either omnidirectional or unidirectional microphone response, a volume control 3, a transmit on/off and unit on/off switch 6, a line input socket 9 (for use with radios or televisions with headphone outputs) and an external power input socket 10. All these controls are immediately accessible.

The system does not depend on a special type of ear-piece. Any existing ear-piece which is capable of remote excitation ('T' facility) will work effectively with this system. The user always has the option of returning to his existing hearing aid system by resetting his ear-piece to its normal/microphone setting thereby taking the aforementioned system out of use.

A wide variety of suitable microphones are readily available in component form from manufacaturers such as Knowles Electronics, Burgess Hill (UK) and from several other manufacturers. These are supplied un-mounted, ready for connecting via suitable solder tabs. For the microphone to function unidirectionally there must be two ports.

The accuracy of the chosen microphone depends upon the shape of the shell in which it is mounted and upon the distance between the two ports. The closing of a rearward port will cause the microphone to operate in an omnidirectional manner. A special moulding attached to the on/off switch 6 mechanically closes the rear port of the microphone 2 as described in detail below. In order to perform this selection electronically the microphone would have to be specially designed and manufactured so as to provide the necessary terminals for connecting an on/off switch to the rear port.

The transmitter for the system, for use in the UK, has to be designed to meet DTI Radio Communications Performance Specification MPT1345. This relates to radio hearing aids. As a result it is recommended that designers have a full knowledge of MPT1345 and low power miniature radio transmitter/receiver technology.

FIG. 2C shows diagramatically, key aspects of the microphone/transmitter unit 1. Data may be received from a microphone 2 or from a direct line input socket 9. The unit 1 is powered by a miniature battery or batteries. The signal is then amplified by amplifier 57 and transmitted via the transmitter 41 and antenna.

A second embodiment of the invention will now be described with reference to FIGS. 3A, 3B, 3C, 3D, 3E, 3F, 4A, 4B,5, 6, 7B and 8A, 8B and 8C. As can be seen from the Figures, a portable microphone and transmitter unit 17 comprises an elongate member approximately 10 cm in length with a directional microphone 18 located at one end. Mounted on an upper surface is a 'mode select' switch 19 which enables a user to choose between having a directional or an omnidirectional microphone activated, and an 'on/off/volume control' switch 20 which enables the user to increase or decrease volume level and also to easily control whether the microphone/transmitter unit 17 is on or off.

Figure 8A:
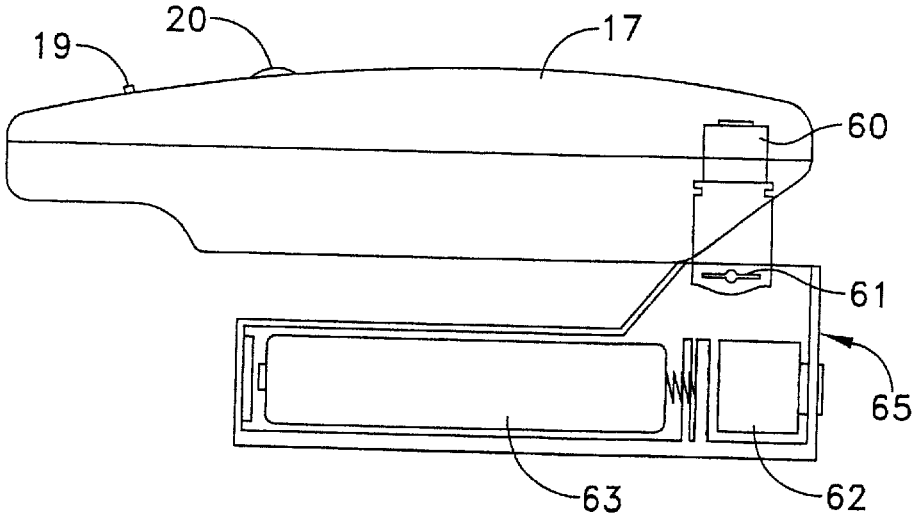
FIG. 8A is a sectional view of a transmitter unit mounted on a battery pack.
Figure 8B:
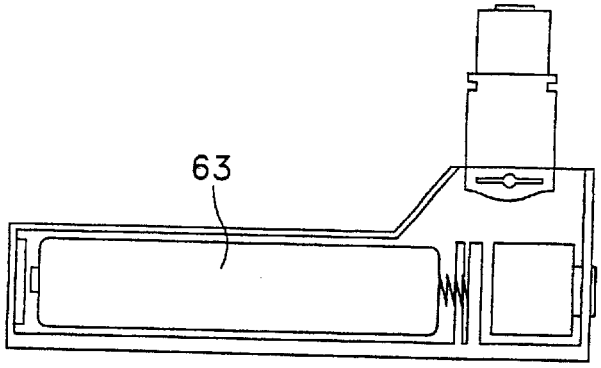
FIG. 8B is a sectional view of the battery pack of FIG. 8A.
Figure 8C:
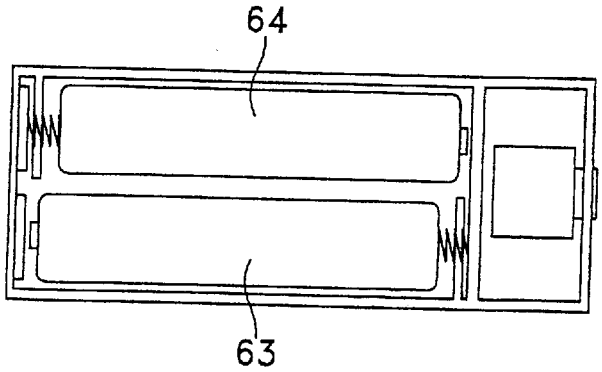
FIG. 8C is a plan view of the battery pack.

The design of switches 19 and 20 is such as to enable handicapped or infirm users to operate them without difficulty. The whole portable unit 17 is designed to be comfortably held within the palm of the user's hand and also to be easily rested on a table surface (not shown) for example in front of a television, using an integral stand 21. There is also a miniature line input socket 22 provided on the base of the transmitter unit 17 to allow connection to a line output of audio or television equipment. The unit 17 is powered by miniature batteries 43 and 44 which may or may not be rechargeable. Alternatively, the unit 17 may be powered from an external power source, such as mains electricity via an adaptor, the unit 17 being connected to such external power source by an input socket or via the terminals within the battery enclosure 45. An example of such an adaptor housing batteries is shown in FIGS. 8A, 8B and 8C.

The unit 17 may have a battery low indicator 33. The operation of the transmitter unit 17 is described below with reference to FIG. 5.

Figure 4A:
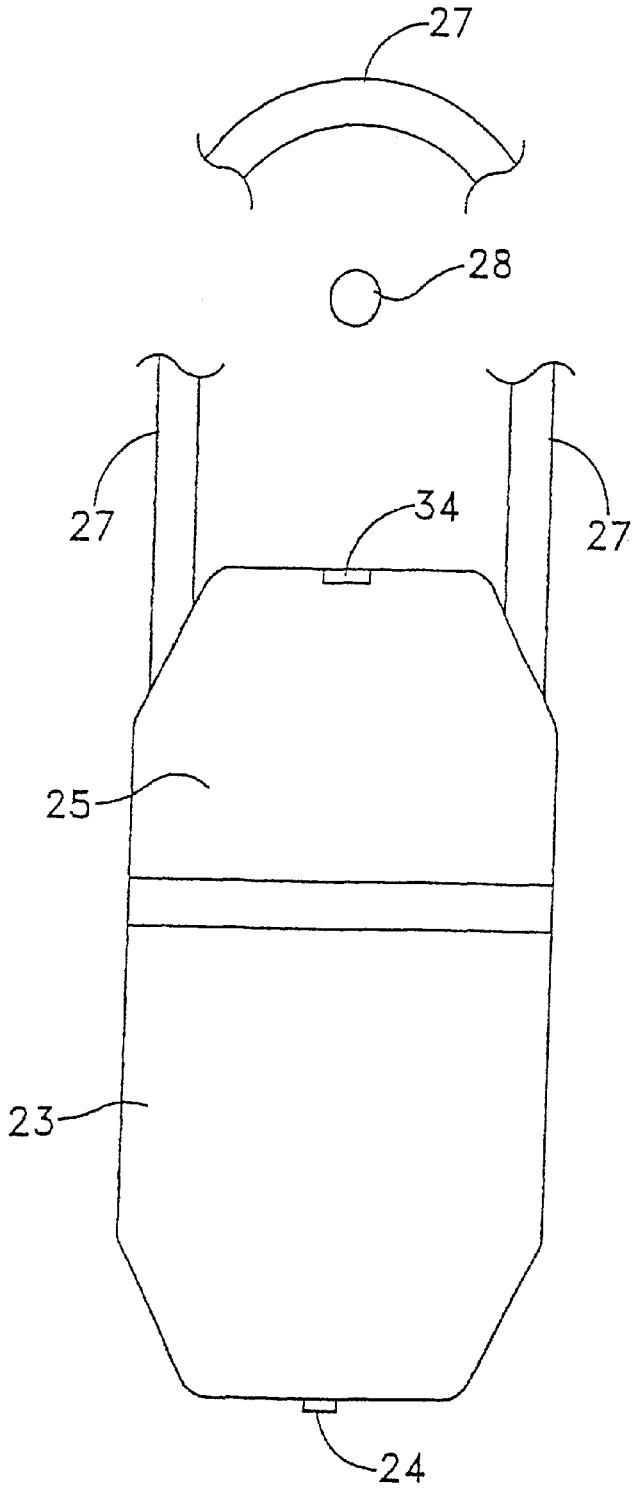
FIG. 4A is a front view of an alternative embodiment of a receiver/amplifier unit.
Figure 4B:
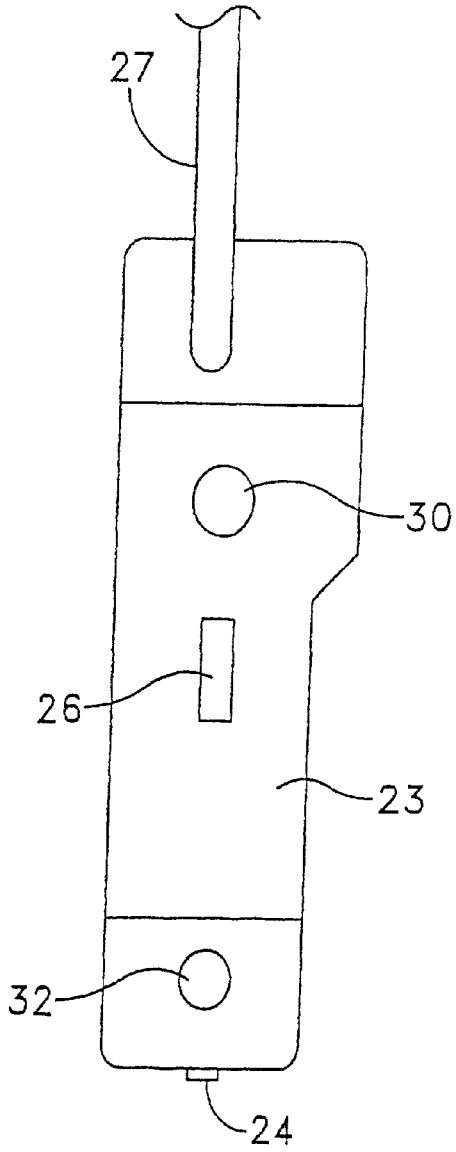
FIG. 4B is a side elevational view of the receiver/amplifier unit of FIG. 4A.

The signal from the microphone 18 or the input socket 22 is transmitted to a receiver/amplifier unit 23 shown in FIGS. 4A and 4B. The operation of this is described below with reference to FIG. 6. The receiver unit 23 is in the form of a generally rectangular slim box measuring approximately 35 mm (width)×65 mm (height)×17 mm (depth at top) and 14 mm (depth at bottom). The unit 23 contains the necessary electronic circuitry to receive a signal 36 from the microphone/transmitter unit 17, and to amplify the received signal. The unit 23 is provided with an easily operable 'stand-by on/off' switch 24, mounted on its base. The unit 23 is powered by miniature batteries which may or may not be rechargeable. Alternatively, the unit 23 may be powered from an external power source such as mains electricity or an external battery pack via an adaptor, the unit 23 being connected to such external power source by means of exposed terminals 32 on its base or lower sides.

The unit 23 may also have a volume control within the switch 24. The unit 23 may also be provided with a microphone 25 to enable the user to receive sounds closer to him/her than the remote unit 17. The unit 23 has an in built local microphone 25 which is operated by a switch 26 which controls whether it is on or off and being used instead of or in addition to the remote microphone 18 on the hand unit 17. The microphone 25 may be connected to a mixer 46 via a variable threshold noise-gate or voice-operated circuit also controlled by the switch 26, allowing sounds such as the ring of a door bell or telephone to be heard via the ear-piece whilst the hand unit 17 is operating in the unidirectional or line input mode. The switch 26 not only switches the microphone 25 on or off, it also provides a selection of volume thresholds for the noise-gate if required. The microphone 25 can be operated with or without the noise-gate.

Connecting to, or arising out of the top of, the unit 23 is an inductive loop necklace 27 which is connected to the radio receiver 47 in the unit 23 via amplifier circuit 35. A signal passes into the light-weight, non-kink inductive loop 27, which is then passed on to a hearing aid ear-piece 28 as shown diagramatically in FIG. 7B, set within the field of the loop i.e. placed within the ear in the vicinity of the inductive loop necklace.

A hearing aid, set to receive in the 'T' mode (telephone/loop mode), will receive an amplified signal 37, and convert it into an audible signal within the ear-piece 28. In this mode there is little or no noise from the hearing aid and the receiver will only pass on the signal to the loop when the microphone/transmitter unit is transmitting. This means that the hearing aid can be set to, and left at, full volume—the level of signal being controlled from the portable remote/transmitter unit 17 or the receiver unit 23. The inductive loop 27 for this embodiment is simply a length of fine wire looped approximately six times to a diameter of approximately 25–30 cm. The two ends of the loop are connected to the output of the receiver via a transformer 29. An amplifier 35 may be connected between the receiver output and the loop. As an alternative to the induction loop method of activating the ear-piece 28, the receiver unit 23 may also have an output socket 30 into which headphones or an earphone may be connected, or even other devices may be connected to further process the signal, such as a booster amplifier or a tape recorder.

The directional microphone 18 can focus on specific sound sources at a distance of several meters if it is mounted in a well designed shell. Connecting the microphone 18 to a miniature radio transmitter 31, within the shell enables the unit 17 to move independently of the rest of the system, giving it the best possible chance of gaining direct access to the chosen sound source. The unit 17 can be held in the hand and pointed towards the sound source or alternatively it can be placed near to, or in "full view" of, the sound source. Within the unit 17 there is a facility 19 for selecting either omnidirectional or unidirectional microphone response, a volume control/transmit on/off and an on/off switch 20; a line input socket 22 (for use with radio or television headphone outputs) and external power input terminals 32. All these controls are immediately accessible.

The system does not depend on a special type of ear-piece. Any existing ear-piece which is capable of remote excitation ('T' facility) will work effectively with this system. The user always has the option of returning to his/her existing hearing aid system by resetting the ear-piece to its normal/microphone setting thereby switching out of circuit the aforementioned system.

The system uses a known microphone 18, which is preferably the Knowles EB 1979. For the microphone 18 to function unidirectionally there must be two ports 51 and 52. The accuracy of the chosen microphone depends upon the shape of the shell in which it is mounted and upon the distance between the two ports 51 and 52. The distance between the two ports is altered by attaching lengths of tubing 49 and 50 to the ports 51 and 52. In this embodiment tube length 49 is 5 mm long and tube 50 is 3 mm long. The closing of the rear port will cause the microphone 18 to operate in an omnidirectional manner.

A sliding door switch 19 mechanically closes the rear port 52 of the microphone 18 in order to make the microphone 18 operate in an omnidirectional manner. Selection of either omnidirectional or unidirectional (focussed) mode is achieved by way of a sliding door switch 19, shown in detail in FIGS. 3E and 3F. The switch 19 moves backwards and forwards on a support 54 so as to either open or close a hole 55 defined in the support 54. A first hollow 5 mm extension tube 49 is connected to the front port 51 of the microphone 18. A second hollow 3 mm extension tube 50 is connected to the rear port 52 of the microphone 18.

By selectively opening either of the two tubes 49 or 50 the microphone 18 is switched either to operate omnidirectionally, i.e. it will detect sounds emanating from all around; or it may operate unidirectionally i.e. so as to detect sounds emanating from within a narrow volume.

In order to perform this selection electronically the microphone 18 would have to be arranged so as to provide the necessary terminals for connecting an on/off switch to the rear port 52. When in the unidirectional mode the microphone 18 also filters out some unwanted frequencies thereby further improving the signal received at the ear-piece 28.

The transmitter for use of either the aforementioned system in the UK, has to be designed to meet the DTI Radio Communications performance specification MPTI345 (which relates to radio hearing aids).

A variety of transmission frequencies may be used. For example in the UK there are approximately eight frequencies specifically intended for radio hearing aids. The aforementioned system may operate at one of a plurality of frequencies thereby allowing the use of several individual systems in close proximity without causing interference.

Figure 5:
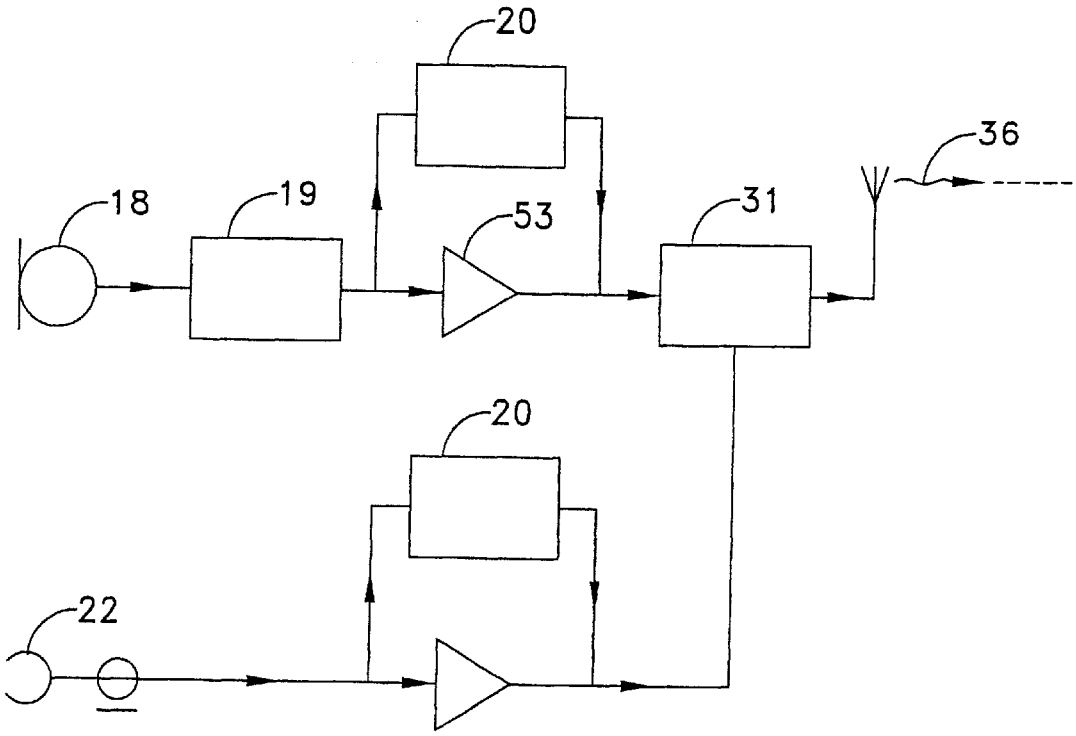
FIG. 5 is a block diagram showing diagramatically the circuit of the microphone/transmitter unit of FIG. 3A.
Figure 6:
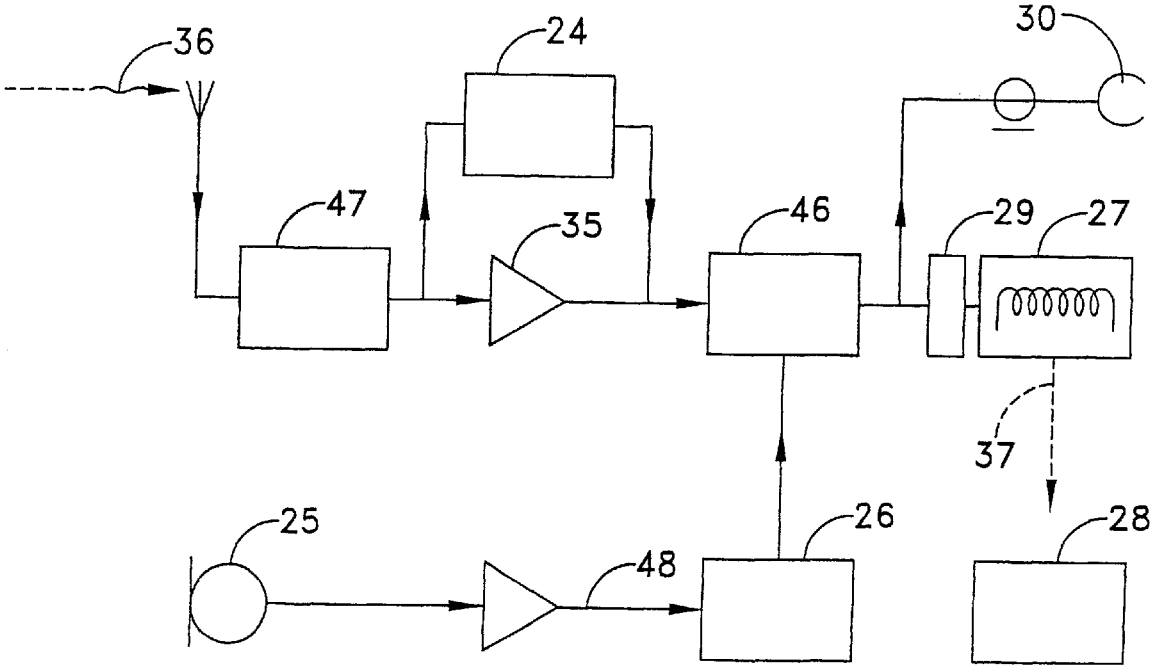
FIG. 6 is a block diagram showing diagrammatically the diagram of the receiver/amplifier unit of FIG. 4A.
Figure 7B:
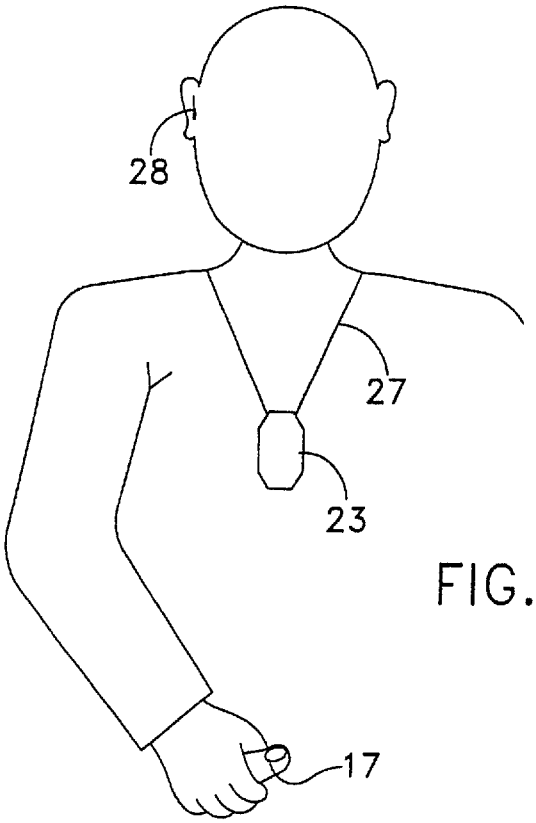
FIG. 7B is a diagram of a user wearing the system shown in FIGS. 3A and 4A.

Brief reference will now be made to FIGS. 5, 6 and 7B and to the operation of the system.

A microphone 18 focussed at a desired sound source, for example a speaker, is by way of a selectable unidirectional switch 19, detects sounds and converts them into suitable signals. The signals are amplified at amplifier 53 in accordance with a desired volume level selected by the user at volume control 20. The signal is then transmitted at approximately 173 MHz.

It will be readily appreciated that a direct line, for example from a television or a stereo, may be connected to line input 22 for subsequent transmission.

The transmitter 31 transmits to the receiver's antenna, which may be within the receiver unit 4 or embedded in the loop supporting the receiver 4. The received signal 36 is filtered and amplified by amplifier 35. The amount of amplification may be varied by a volume control 24. If applicable the amplified signal is mixed with a separate voice (overlay) signal from local microphone 14 and voice operated switch 26. The resultant signal passes to an inductive loop 27 and is eventually detected by a hearing aid 28 lying within the magnetic field of the loop 27.

It will be apprecited that variation to the above embodiments may be made without departing form the scope of the invention.

It will be appreciated that further variation to the aforementioned embodiments may be made for example by arranging for transmitter units and/or receiver units to have a conference facility such that a single transmitter could transmit to several users.

Variation to the fourth aspect of the invention may also be made without departing from the scope of the invention. For example the contact cylinder 60 may be in the form of a key-in-lock arrangement. Pivot lock 61 could comprise a clasp or separate locking straps. DC input port 62 may be arranged to receive direct current from a transformer/rectifier or from batteries 63 and 64. Adaptor 65 may be in the form of an integral stand or support.

What is claimed is:

1. A hearing aid system comprising:

a transmitter/microphone unit constructed and arranged to be held in the hand of a user of the hearing aid system, said transmitter/microphone unit being constructed and arranged to receive sounds which are both proximate to the transmitter/microphone unit and distant from the transmitter/microphone unit and transmitting a signal comprising said proximate and distant sounds;

a receiver unit for receiving said signal from the transmitter/microphone unit, the receiver unit including an amplifier;

an induction loop coupled to said amplifier of said receiver unit, said induction loop being constructed and arranged to allow said receiver unit to be supported by the user, said induction loop being operative to transmit an electrical signal received from said amplifier;

said transmitter/microphone unit having a transmission range which slightly exceeds a distance between said transmitter and said receiver unit when said transmitter is held in the hand of the user and the receiver unit is supported by the user; and an earpiece being adapted to be support ed by an ear of the user, said earpiece being separate from both said transmitter/microphone unit and said receiver unit and being capable of receiving said signal transmitted from said induction loop and converting said electrical signal to an audio signal;

wherein said transmitter/microphone unit is constructed and arranged to provide aural focus upon the manual command of the user without dependence upon and without prejudice to either head movement of the user, the user's field of vision, or both, said aural focus being achieved by manually pointing the transmitter/microphone unit in a desired direction and by selecting, by means of a switch of the transmitter unit, one of a unidirectional and omnidirectional microphone mode.

2. The system of claim 1, said transmitter/microphone unit comprising a volume adjustment device.

3. The system of claim 1, wherein said switch is mechanical.

4. The system of claim 1, wherein said switch is electrical.

5. The system of claim 1, said transmitter/microphone unit further comprising an integral stand for supporting said transmitter/microphone unit.

6. The system of claim 1, said transmitter/microphone unit further comprising input terminals operative for connecting external devices to said transmitter/microphone unit.

7. The system of claim 1, wherein said induction loop is constructed and arranged to be suspended from the neck of the user, said receiver unit being suspended from said induction loop.

8. The system of claim 1, wherein said transmitter/microphone unit and said receiver unit are capable of being tuned to a number of different transmitter frequencies.

9. The system of claim 1, wherein said amplifier of said receiver unit includes a frequency equalizer to adjust sound received to remove undesired frequencies and to boost desired frequencies.

10. The system of claim 1, wherein the induction loop is coupled to said amplifier of said receiver unit, and said induction loop [being] is operative to transmit an electrical signal received from said amplifier to said earpiece.

* * * * *